US006645012B2

(12) United States Patent
Ito et al.

(10) Patent No.: US 6,645,012 B2
(45) Date of Patent: Nov. 11, 2003

(54) CARD EDGE CONNECTOR COMPRISING A HOUSING AND A PLURALITY OF CONTACTS

(75) Inventors: Toshiyasu Ito, Togane (JP); Yasuhiro Ono, Yokohama (JP)

(73) Assignee: Yamaichi Electrics Co., Ltd., Tokyo (JP)

( * ) Notice: Subject to any disclaimer, the term of this patent is extended or adjusted under 35 U.S.C. 154(b) by 0 days.

(21) Appl. No.: 09/922,866

(22) Filed: Aug. 7, 2001

(65) Prior Publication Data

US 2002/0022381 A1 Feb. 21, 2002

(30) Foreign Application Priority Data

Aug. 8, 2000 (JP) ..... 2000-240259

(51) Int. Cl.[7] ..... H01R 24/00
(52) U.S. Cl. ..... 439/637; 439/862
(58) Field of Search ..... 439/637, 636, 439/861, 862, 858, 60

(56) References Cited

U.S. PATENT DOCUMENTS

| | | | | |
|---|---|---|---|---|
| 1,477,527 A | | 4/1923 | Raettig | 200/282 |
| 3,040,291 A | | 6/1962 | Schweitzer | 439/637 |
| 3,601,774 A | | 8/1971 | Stathos et al. | 439/627 |
| 3,631,381 A | * | 12/1971 | Pittman | 439/637 |
| 4,392,705 A | | 7/1983 | Andrews, Jr. et al. | 439/342 |
| 4,507,697 A | | 3/1985 | Ozil et al. | 361/1 |
| 4,734,041 A | | 3/1988 | Bruchmann et al. | 439/637 |
| 5,401,185 A | | 3/1995 | Wang et al. | 439/441 |
| 5,716,221 A | | 2/1998 | Kantner | 439/64 |
| 5,725,385 A | | 3/1998 | Takano et al. | 439/64 |
| 5,904,597 A | | 5/1999 | Doi et al. | 439/660 |
| 5,933,328 A | | 8/1999 | Wallace et al. | 361/737 |
| 5,993,261 A | | 11/1999 | Klatt et al. | 439/630 |
| 6,004,155 A | | 12/1999 | Wu | 439/489 |
| 6,036,548 A | | 3/2000 | Braithwaite | 439/637 |
| 6,099,335 A | | 8/2000 | Chang | 439/188 |
| 6,102,715 A | | 8/2000 | Centofante | 439/140 |
| 6,162,075 A | | 12/2000 | Hara et al. | 439/159 |
| 6,162,089 A | | 12/2000 | Costello et al. | 439/541.5 |
| 6,174,198 B1 | | 1/2001 | Wu et al. | 439/541.5 |

(List continued on next page.)

FOREIGN PATENT DOCUMENTS

| | | |
|---|---|---|
| JP | 47-41714 | 10/1972 |
| JP | 50-56987 | 9/1975 |
| JP | 61-118980 | 6/1986 |
| JP | 4-8618 | 3/1992 |
| JP | 06-036834 | 2/1994 |
| JP | 6-77178 | 10/1994 |
| JP | 08-236187 | 9/1996 |
| JP | 09-027367 | 1/1997 |
| JP | 11-111402 | 4/1999 |
| JP | 2000-502490 | 2/2000 |
| JP | 2000-251024 | 9/2000 |
| JP | 2000-251025 | 9/2000 |
| JP | 2002-117945 | 4/2002 |
| JP | 2002-124343 | 4/2002 |

OTHER PUBLICATIONS

U.S. patent application Ser. No. 09/840,109, Nishimura, filed Apr. 24, 2001.

U.S. patent application Ser. No. 09/842,083, Nishimura, filed Apr. 26, 2001.

(List continued on next page.)

*Primary Examiner*—Javaid Nasri
(74) *Attorney, Agent, or Firm*—Finnegan, Henderson, Farabow, Garrett & Dunner, L.L.P.

(57) ABSTRACT

Each of the contacts comprises a plurality of stacked contact pieces. The contact portions of each of the stacked contact pieces are allocated in the direction of the length of the contact within a size of the corresponding pad. This arrangement can minimize a temperature rise in the contact.

8 Claims, 11 Drawing Sheets

U.S. PATENT DOCUMENTS

| | | | | |
|---|---|---|---|---|
| 6,176,737 | B1 | 1/2001 | Choy | 439/541.5 |
| 6,183,292 | B1 | 2/2001 | Chen et al. | 439/541.5 |
| 6,250,965 | B1 | 6/2001 | Neifer | 439/630 |
| 6,261,128 | B1 | 7/2001 | Heim et al. | 439/630 |
| 6,315,615 | B1 | 11/2001 | Raistrick | 439/637 |
| 6,328,605 | B1 | 12/2001 | Walker et al. | 439/631 |
| 6,402,529 | B2 | 6/2002 | Saito et al. | 439/74 |
| 6,409,546 | B1 | 6/2002 | Ito et al. | 439/630 |
| 6,482,029 | B2 | 11/2002 | Nishimura | 439/541.5 |

OTHER PUBLICATIONS

U.S. patent application Ser. No. 09/978,664, Sato, filed Oct. 18, 2001.

U.S. patent application Ser. No. 10/046,716, Ooya et al., filed Jan. 17, 2002.

U.S. patent application Ser. No. 10/057,944, Mithuhashi et al., filed Jan. 29, 2002.

U.S. patent application Ser. No. 10/067,891, Ito et al., filed Feb. 8, 2002.

U.S. patent application Ser. No. 10/090,800, Takeyama et al., filed Mar. 6, 2002.

Japanese Office Action dated Jan. 24, 2003 and English Translation.

* cited by examiner

CARD EDGE CONNECTOR COMPRISING A HOUSING AND A PLURALITY OF CONTACTS

This application is based on Patent Application No. 2000-240259 filed Aug. 8, 2000 in Japan, the content of which is incorporated hereinto by reference.

BACKGROUND OF THE INVENTION

1. Field of the Invention

The present invention relates to a card edge connector into which a card type circuit board having a plurality of contact pads at its end portion is inserted.

2. Description of the Related Art

A card edge connector electrically connects a card type circuit board which is of a printed circuit board having an array of conductive contact pads on one or both surfaces of its end portion to a printed circuit board of a variety of kinds of electronic devices.

The card edge connector of this kind normally has a rectangular parallelepiped housing with a slot through which the card type circuit board is inserted into the housing, and a plurality of elastic contacts arrayed on one or both sides of the slot.

In case that a double-faced card type circuit board having contact pads arrayed on its both surfaces is inserted into a double-faced card edge connector, which is one type of the above-described card edge connector, on condition that the card type circuit board is supplied with electricity from a mother board on which the connector is mounted or from a cable connected to the connector, contact pads on one surface of the card type circuit board are applied with positive voltage and contact pads on the other surface with negative voltage.

The contact that electrically connects to the contact pad is made from a leaf spring material and has a connecting portion connected to the mother board or cable, a fixed portion fixed in the connector housing, a spring portion and a contact portion.

In the conventional card edge connector, each contact is provided with one contact portion to connect with a corresponding one of the contact pads of the card type circuit board, so that when large electric power is supplied to the card type circuit board, the large current flows through the contacting portion between the contact and the contact pad, raising the temperatures of all portions of the contact, i.e., a contact portion, a spring portion, a fixed portion and a connecting portion. The conventional card edge connector therefore has a problem of a temperature rise in excess of a predetermined allowable temperature range.

SUMMARY OF THE INVENTION

The present invention has been accomplished under these circumstances and its objective is to provide a card edge connector that can prevent an excess of temperature rise in the contacts even when large electric power is fed.

In the first aspect of the present invention, there is provided a card edge connector electrically connecting to a card type circuit board, wherein the card type circuit board has a plurality of contact pads arrayed on at least one of surfaces of an edge portion thereof, the card edge connector comprising:

a housing having a slot into which the card type circuit board is inserted; and a plurality of contacts, each comprising a plurality of stacked contact pieces, each of the stacked contact pieces having a fixed portion to be fixed in the housing, a connecting portion extending from the fixed portion in one direction, a spring portion extending from the fixed portion in the other direction and being elastically displaceable, and a contact portion at a free end of the spring portion;

wherein the contact portions of the plurality of contact pieces are allocated in the direction of the length of the contact within a size of the corresponding contact pad.

Here, the fixed portion, the spring portion and the contact portion of each of the stacked contact pieces may be almost equal in width.

The spring portion and the contact portion of each of the stacked contact pieces may be divided into a plurality of parts in the direction of the width of the contact.

The connecting portions of the plurality of contact pieces may be shifted in the direction of the width of the contact so that the connecting portions do not overlap.

The fixed portions of the plurality of stacked contact pieces may be press-fitted and securely held in each of grooves formed in the housing.

In the second aspect of the present invention, there is provided a card edge connector electrically connecting to a card type circuit board, wherein the card type circuit board has a plurality of contact pads arrayed on at least one of surfaces of an edge portion thereof, the card edge connector comprising:

a housing having a slot for accommodating the card type circuit board is inserted; and a plurality of contacts, each of contacts having a fixed portion to be fixed in the housing, a connecting portion extending from the fixed portion in one direction, a plurality of spring portions extending from the fixed portion in the other direction and being elastically displaceable, and contact portions provided one at a free end of each of the plurality of spring portions;

wherein the contact portions are allocated in the directions of the width and the length of the contact within a size of the corresponding contact pad.

In this invention, the spring portion of each of the stacked contact pieces is divided into a plurality of spring portions so that the contact portions of the contact can be allocated dispersedly in the directions of the width and the length of the contact. This arrangement can increase the number of contact portions to engage the corresponding contact pad, reduce contact resistance and minimize a temperature rise.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described by referring to the accompanying drawings.

Figure 1:
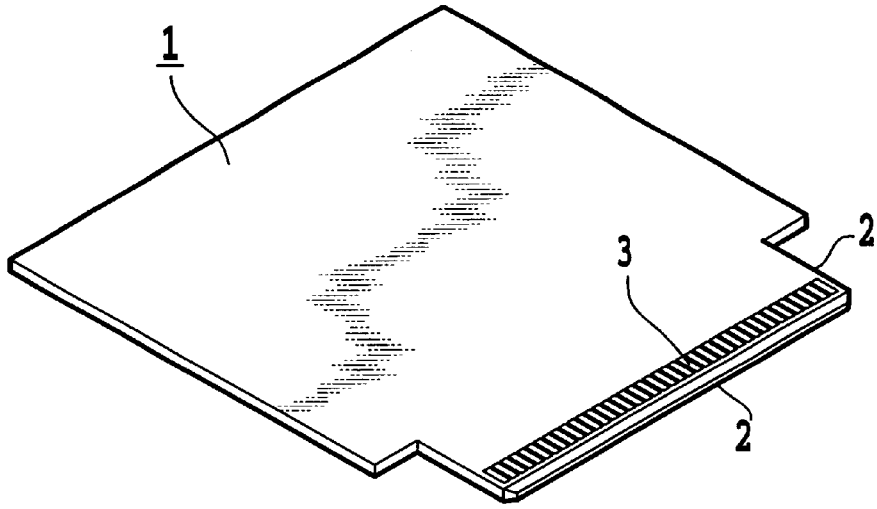
FIG. 1 is a perspective view of an example of a card type circuit board as seen from the front surface side.
Figure 2:
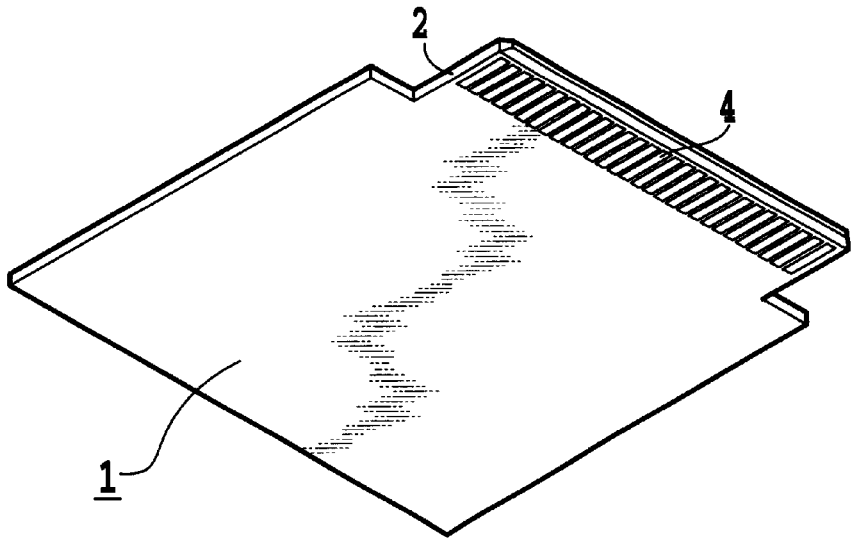
FIG. 2 is a perspective view of the example of the card type circuit board as seen from the back surface side.

FIG. 1 and FIG. 2 show an example of card type circuit board 1, FIG. 1 illustrating the front surface side of the card type circuit board 1 and FIG. 2 the back surface side.

As shown in FIG. 1 and FIG. 2, a card edge portion 2 of the card type circuit board 1 formed with electric circuits is attached on its front and back surfaces with an array of a plurality of contact pads 3, 4.

Figure 3:
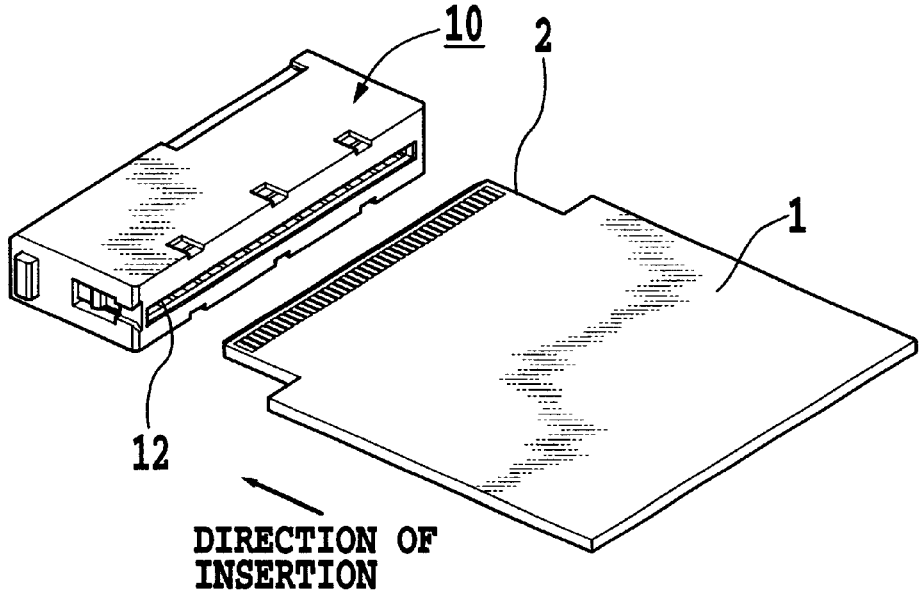
FIG. 3 is a perspective view of an example of the card edge connector before the card type circuit board is inserted into a connector.
Figure 4:
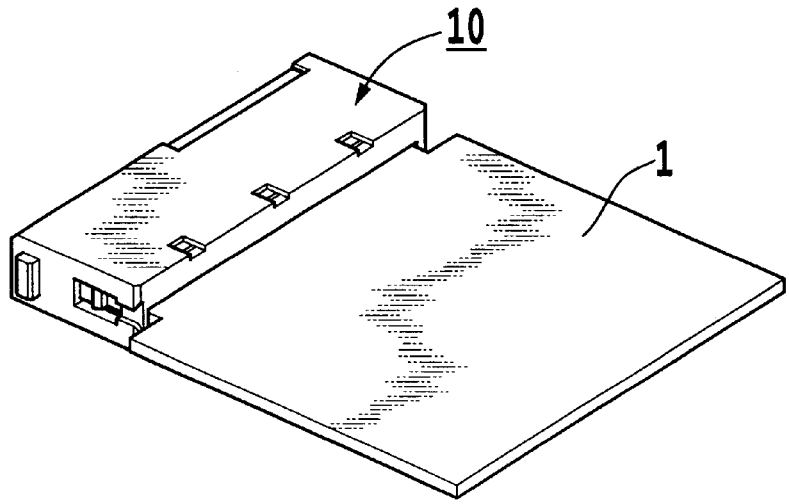
FIG. 4 is a perspective view of the card edge connector after the card type circuit board is inserted into the connector.

The card type circuit board 1 with its card edge portion 2 at the front as shown in FIG. 3 is inserted into a card edge connector 10, as shown in FIG. 4.

Figure 5:
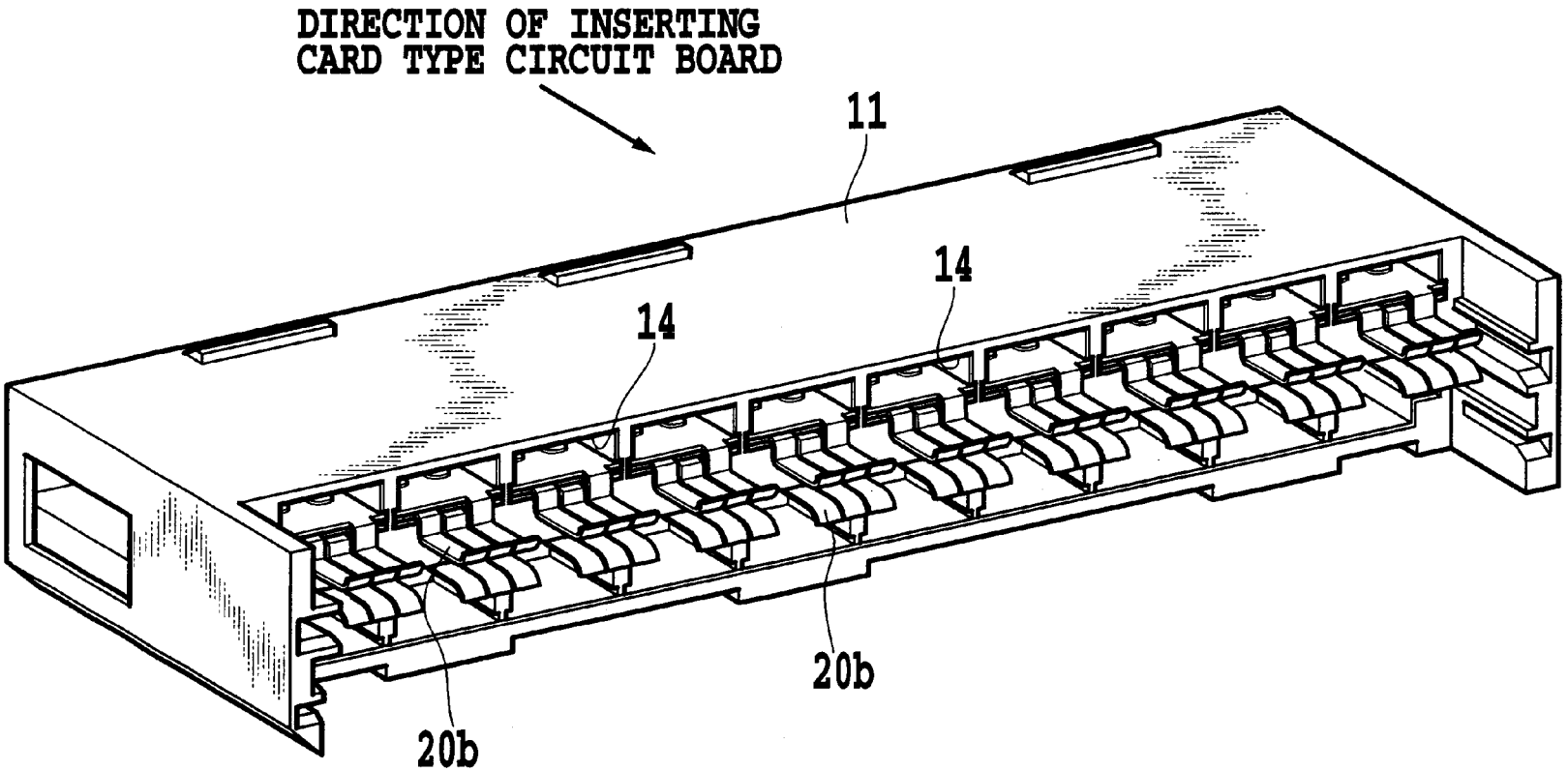
FIG. 5 is a perspective view of the card edge connector of this invention as seen from the back.
Figure 6:
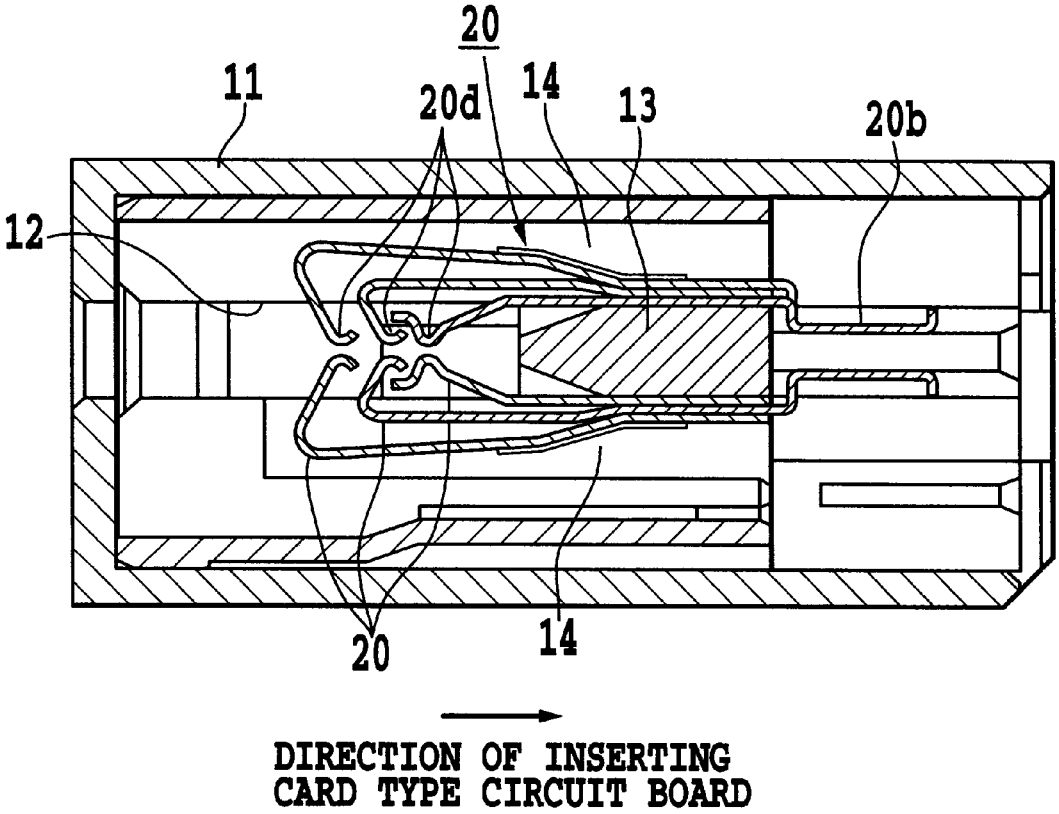
FIG. 6 is a cross-sectional view showing an embodiment of the card edge connector of this invention when the card type circuit board is not inserted.
Figure 7:
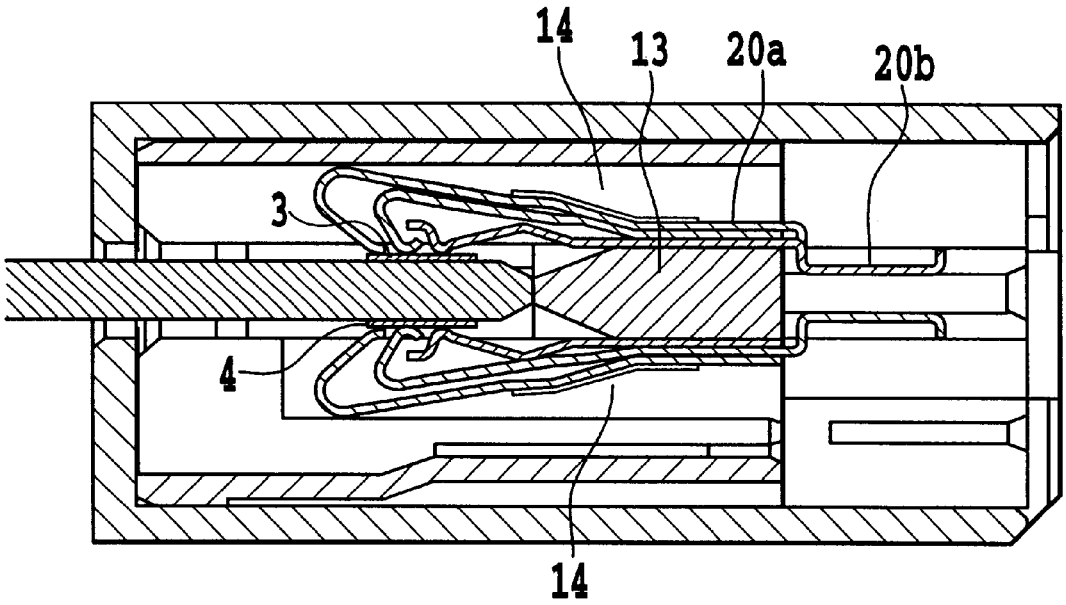
FIG. 7 is a cross-sectional view showing the embodiment of the card edge connector of this invention when the card type circuit board is inserted.

FIG. 5 shows the card edge connector 10 as seen from the back, with an external housing 11*a* removed. FIG. 6 is a cross section of the card edge connector 10 when the card type circuit board 1 is not inserted. FIG. 7 is a cross section of the card edge connector 10 loaded with the card type circuit board 1.

As shown in these figures, the card edge connector 10 has a connector housing 11 made from resin or the like. The connector housing 11 comprises an external housing 11*a* and an internal housing 11*b*.

The connector housing 11 has a rectangular slot 12, or elongate groove, formed in one of its sides through which the card type circuit board 1 is inserted. At the rear of the slot 12 there is provided a stopper member 13 that the card edge portion 2 of the inserted card type circuit board 1 engages.

Figure 8:
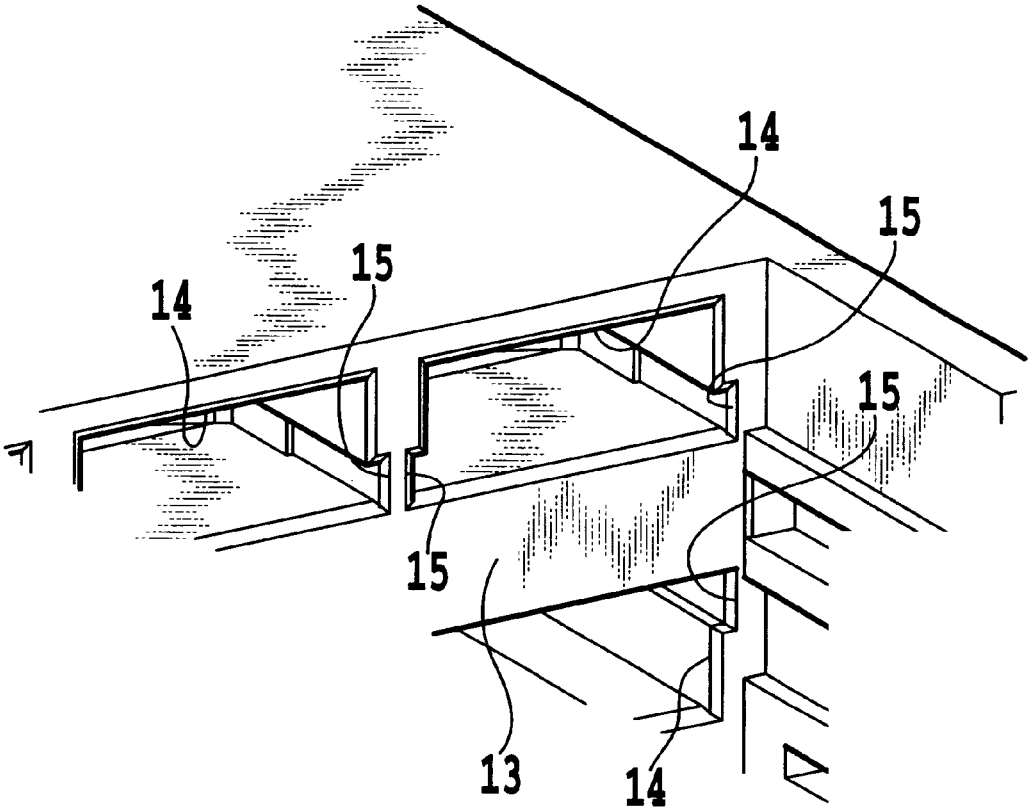
FIG. 8 is a perspective view showing press-fit grooves for the contacts.
Figure 9:
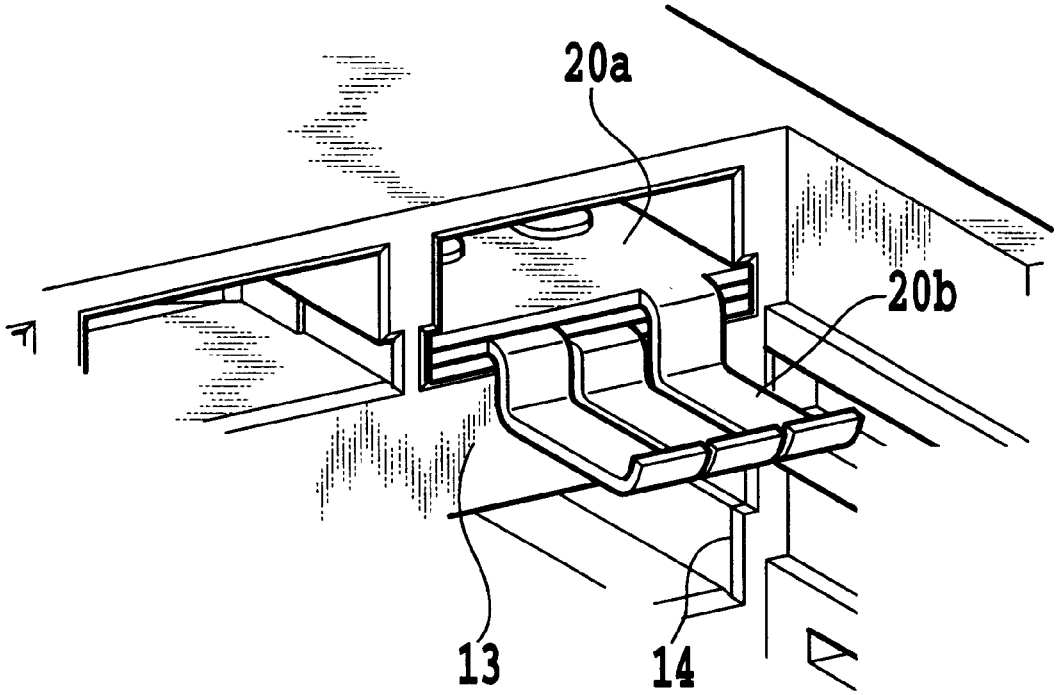
FIG. 9 is a perspective view showing the press-fit grooves in which a contact is press-fitted.

The connector housing 11 has a plurality of contact accommodating portions 14 above and below the slot 12, as shown in FIG. 6, each of which accommodates a contact 20 whose front end portions 20*d* are movable in a direction almost perpendicular to the direction in which the card type circuit board 1 is inserted into the slot 12. At the rear part of the contact accommodating portions 14, press-fit grooves 15 for rigidly holding the fixed portion of the contact 20 are formed on both lateral sides of each contact accommodating portion 14, as shown in FIG. 8 and FIG. 9.

The contacts 20 made from elastic conductive metal are installed in these contact accommodating portions 14 so that paired contacts 20 are opposed to each other.

Figure 10:
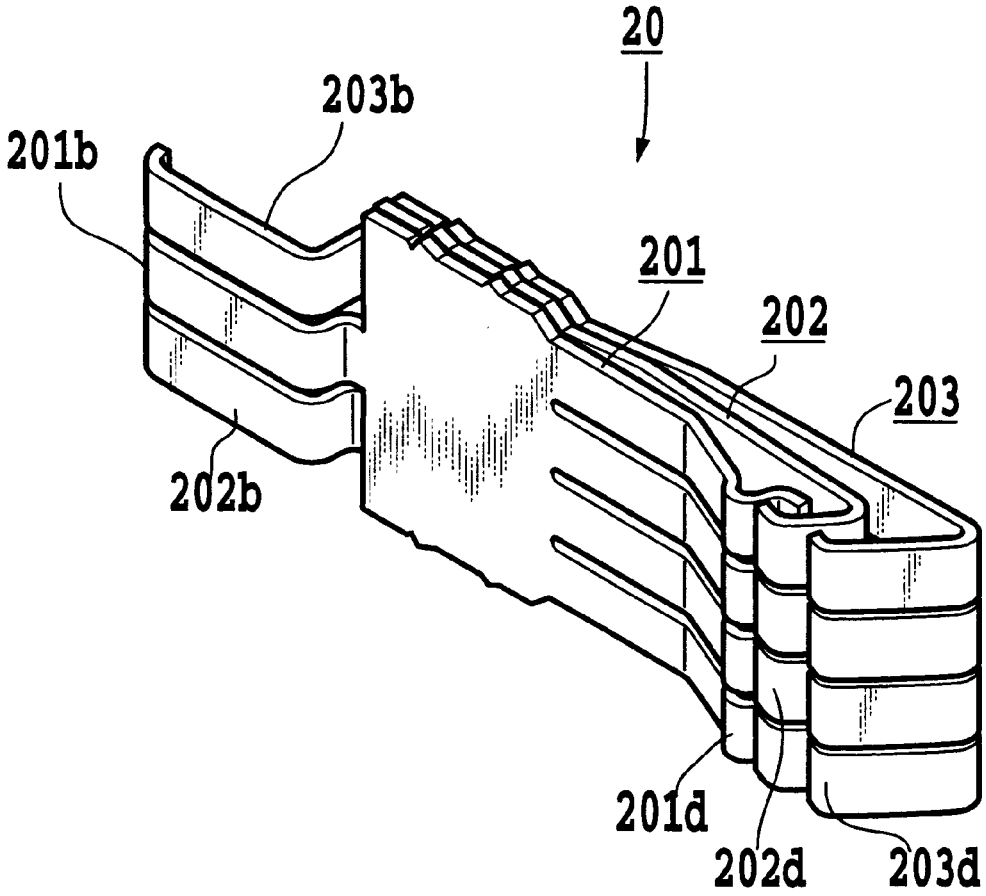
FIG. 10 is a perspective view showing an embodiment of the contact 20.
Figure 11:
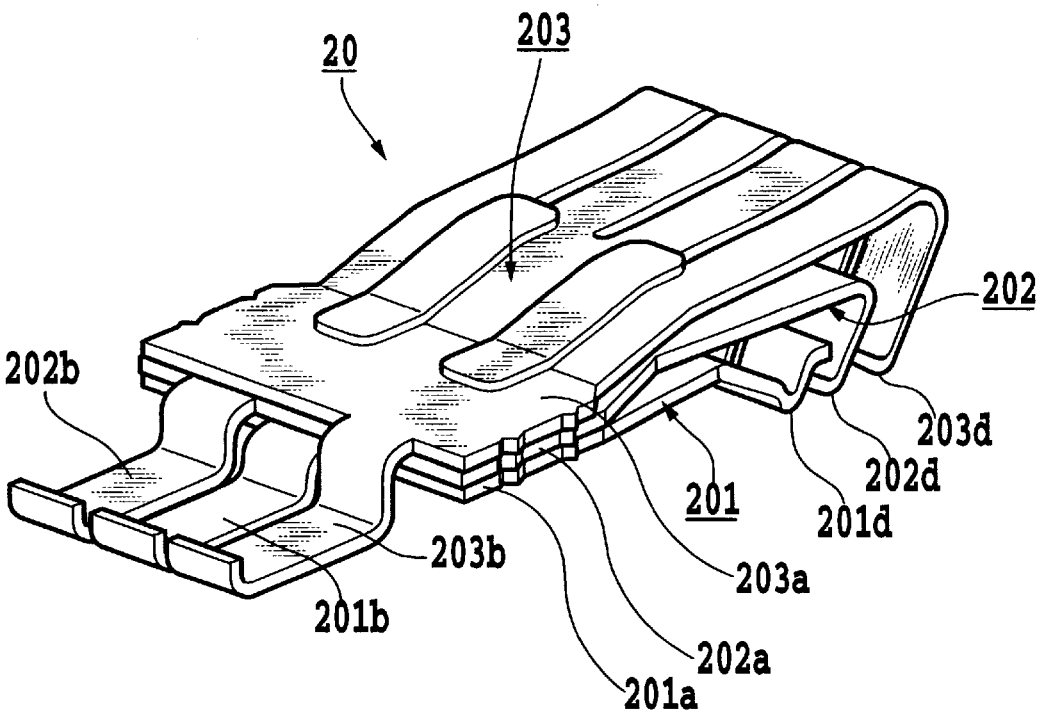
FIG. 11 is a perspective view showing the same embodiment of the contact 20 as seen from a different angle.
Figure 12:
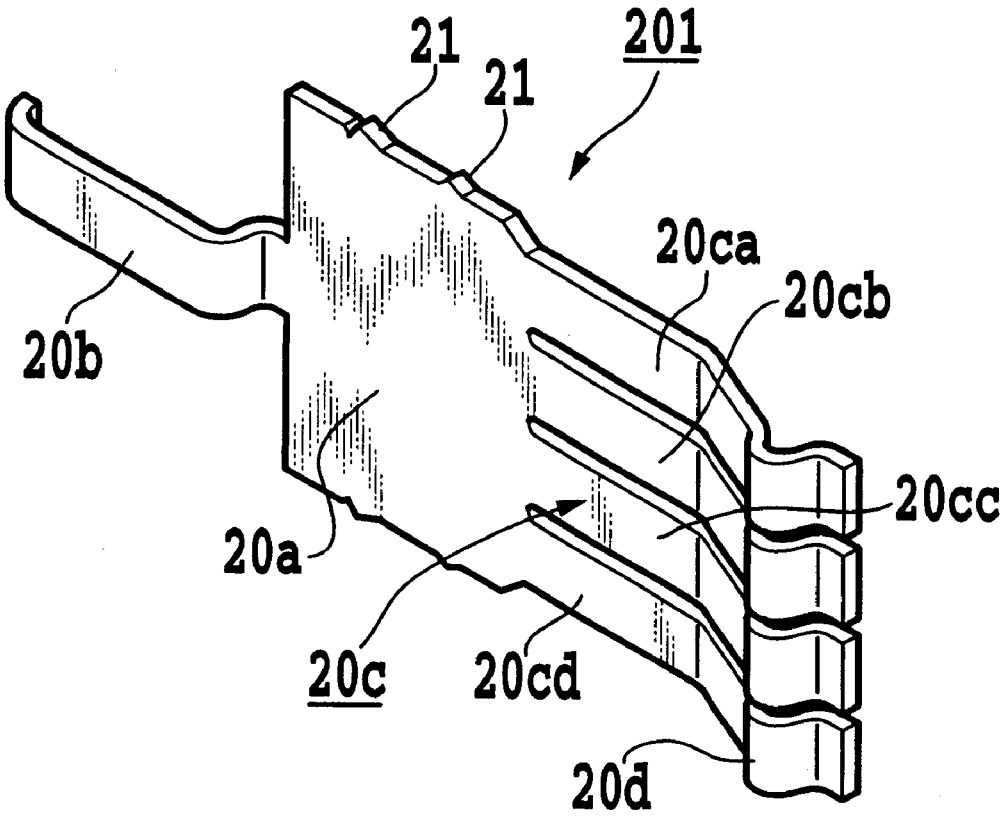
FIG. 12 is a perspective view showing a single contact piece.

FIG. 10 and FIG. 11 show one example shape of the contact 20, and FIG. 12 shows an example of a contact piece 201.

As shown in these figures, the contact 20 comprises three stacked contact pieces 201, 202, 203.

Each of contact pieces 201, 202, 203 is formed from cantilevered leaf spring, as shown in FIG. 12, and comprises a rectangular fixed portion 20*a* press-fitted into a press-fit groove 15, a connecting portion 20*b* extending from the fixed portion 20*a* in one direction to be connected to a printed circuit board or a mother board or to a cable, and a plurality of spring portions 20*c* that extend from the fixed portion 20*a* in the other direction to be displaced elastically.

The spring portions 20*c* are bent at a predetermined angle from the fixed portion 20*a* and have a folded or crooked contact portions 20*d* that engage corresponding one of the contact pads 3, 4 of the card type circuit board 1. The fixed portion 20*a* has on both lateral sides a plurality of projections 21 for engagement with the press-fit grooves 15 to rigidly hold the fixed portion 20*a*.

The spring portion 20*c* of the contact piece 201 is divided into a plurality (in this case, four) of spring portions 20*ca*, 20*cb*, 20*cc*, 20*cd* (see FIG. 12). Similarly in the contact pieces, 202, 203, the spring portion 20*c* is also divided into four spring portions. The full width of each contact piece 201, 202, 203 of which spring portion 20*c* is divided into four spring portions is so set that the contact portions 20*d* can engage a corresponding one of the contact pads 3 or 4.

When we look at the contact portions 20*d* (201*d*, 202*d*, 203*d*) of the three stacked contact pieces 201, 202, 203, as shown in FIG. 10 and FIG. 11, it is seen that these contact portions 201*d*, 202*d*, 203*d* are allocated in the direction of the length of the contact 20 within a size of each of the contact pads 3 or 4.

For the contact portions of the three stacked contact pieces 201, 202, 203 to be allocated in the direction of the length of the contact 20, the inclination angle of the spring portion 20*c* with respect to the fixed portion 20*a* is set larger for the contact pieces 202, 203 than that for the contact piece 201 and the free ends of the spring portions 20*c* of these contact pieces 202, 203 are crooked or bent.

In this example, as shown in FIG. 10, each width of the contact portions of the four divided spring portions of the contact piece is set almost equal. Further, the widths of these contact portions are also equally set among the contact pieces 201, 202, 203.

As to the connecting portions 20*b* (201*b*, 202*b*, 203*b*) of the three contact pieces 201, 202, 203, they are shifted widthwise with respect to their fixed portions 201*a*, 202*a*, 203*a* such that the connecting portions 201*b*, 202*b*, 203*b* of the contact pieces do not overlap each other and are situated almost at the same height when the contact pieces 201, 202, 203 are stacked together.

This arrangement can shorten the distance from the end of the fixed portion 20*a* to the connecting portion 20*b* to be soldered, thus reducing electric resistance of the connector 10 when the connector 10 is mounted on a mother board. Further, because the connecting portions 201*b*, 202*b*, 203*b* are arranged in line at almost the same height, the soldering operation is made easy.

Further, since the widths of the fixed portions 20*a* of the three contact pieces 201, 202, 203 are set almost equal, as shown in FIG. 11, these three contact pieces 201, 202, 203 can be press-fitted or fitted under pressure into the press-fit grooves 15 of the connector housing 11 at one time, as shown in FIG. 9.

With this card edge connector, the card edge portion 2 of the card type circuit board 1 is set to the opening of the slot 12 in the connector housing 11 and the card type circuit board 1 is inserted into the slot 12 until the front end of the card edge portion 2 engages the farthest end of the slot 12.

As a result, the contact portions 20*d* of the contacts 20 are pressed against the corresponding contact pads 3, 4 of the card type circuit board 1, thereby establishing an electrical connection between them.

A temperature rise of the contacts depends on ohmic resistance of the contacts and decreases as the resistance is lower. The ohmic resistance of the contact is determined by a conductivity dependent on material of the contact, and by a cross-sectional area of a portion where the electric current flows. If the same material is used, the larger the cross-sectional area, the lower the resistance.

There is a contact resistance in that part of the contact 20 which engages the contact pad 3, 4 of the card type circuit board 1, i.e., the contact portion 20*d*. The contact resistance is determined by an area of the contact portion 20*d* that is actually in contact with the contact pad 3, 4. A temperature rise decreases as the contact area increases. The size of the contact area depends on the width and the number of the contact portions. The greater the width of the contact portion and the number of contacting locations, the smaller the temperature rise of the contact 20 will be.

It is rare that the contact portion 20*d* and the surface of the contact pad of the card type circuit board 1 are perfectly parallel.

The contact area might be reduced even though the width of the contact portion becomes wider if only one part of the contact portion in the direction of the width engages the contact pad surface. To deal with this situation, this embodiment divides widthwise the spring portion of each of the contact pieces 201, 202, 203 into a plurality of spring portions. That is, the divided spring portions, when the card type circuit board 1 is inserted, can twist or deform because of their elasticity according to the flatness or coplanarity of the surface of the pad, thus assuring that the contact portions of all the spring portions reliably engage the contact pad surface.

Figure 13:
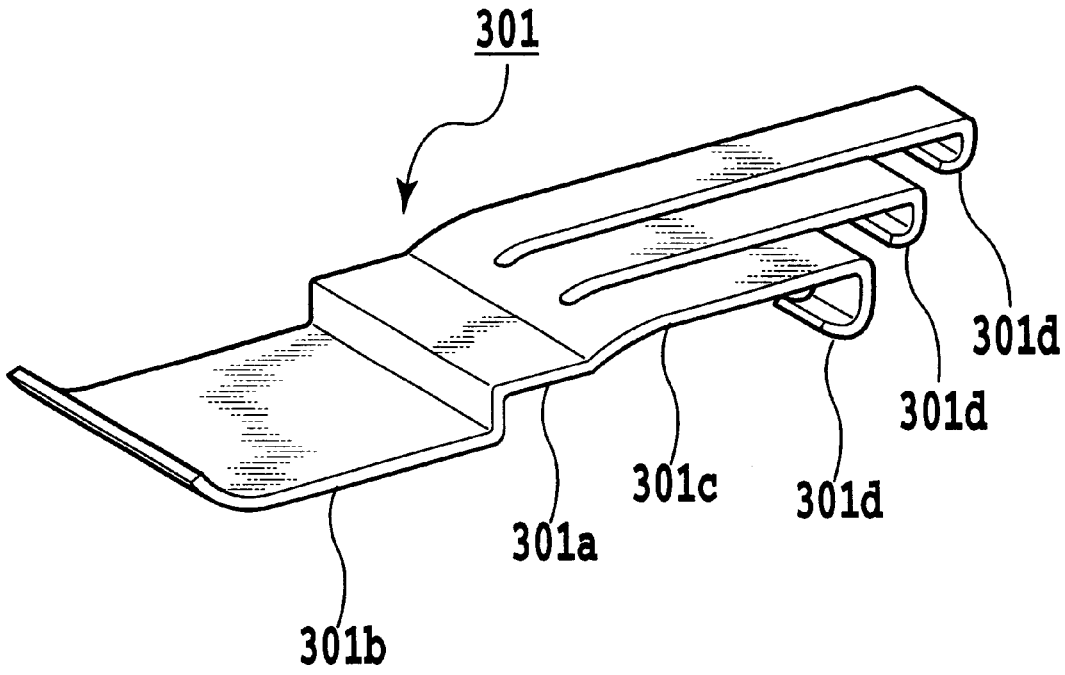
FIG. 13 is a perspective view showing an embodiment of the contact with contact portions allocated in the directions of the width and the length of each contact.

Although in this embodiment a plurality of contact pieces are stacked together to form the contact 20, it is possible to use a single contact piece to form a contact 301 having a fixed portion 301*a*, a connecting portion 301*b*, and a spring portion 301*c* divided into a plurality of spring portions each having a contact portion 301*d* so that the contact portions 301*d* are scatteringly or dispersedly allocated in the mating contact pad in the directions of the width and the length of the contact, as shown in FIG. 13. With this construction, the number of contact portions in contact with the corresponding contact pad can be increased compared with the conventional contact, thus reducing contact resistance and minimizing a temperature rise of the contact.

Further, while the above embodiment takes as an example a card edge connector for use with a card type circuit board having contact pads arranged on both of its surfaces, the present invention can also be applied to a connector for a card type circuit board having the contact pads on only one of its surfaces.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A card edge connector electrically connecting to a card type circuit board, wherein the card type circuit board has a plurality of contact pads arrayed on at least one of surfaces of an edge portion thereof, the card edge connector comprising:

a housing having a slot into which the card type circuit board is inserted; and a plurality of contacts, each comprising a plurality of stacked contact pieces, each of the stacked contact pieces having a fixed portion to be fixed in the housing, a connecting portion extending from the fixed portion in one direction, a spring portion extending from the fixed portion in another direction and being elastically displaceable, and a contact portion at a free end of the spring portion;

wherein the contact portions of the plurality of contact pieces are allocated in the direction of the length of the contact within a size of the corresponding contact pad.

2. The card edge connector according to claim 1, wherein the fixed portion, the spring portion and the contact portion of each of the stacked contact pieces are almost equal in width.

3. The card edge connector according to claim 2, wherein the fixed portions of the plurality of stacked contact pieces are press-fitted and securely held in each of grooves formed in the housing.

4. The card edge connector according to claim 1, wherein the spring portion and the contact portion of each of the stacked contact pieces are divided into a plurality of parts in the direction of the width of the contact.

5. The card edge connector according to claim 4, wherein the fixed portions of the plurality of stacked contact pieces are press-fitted and securely held in each of grooves formed in the housing.

6. The card edge connector according to claim 1, wherein the connecting portions of the plurality of contact pieces are shifted in the direction of the width of the contact so that the connecting portions do not overlap.

7. The card edge connector according to claim 6, wherein the fixed portions of the plurality of stacked contact pieces are press-fitted and securely held in each of grooves formed in the housing.

8. The card edge connector according to claim 1, wherein the fixed portions of the plurality of stacked contact pieces are press-fitted and securely held in each of grooves formed in the housing.

* * * * *